United States Patent [19]

Davis

[11] 4,341,990

[45] Jul. 27, 1982

[54] HIGH FREQUENCY LINE RIPPLE CANCELLATION CIRCUIT

[75] Inventor: William F. Davis, Tempe, Ariz.

[73] Assignee: Motorola, Inc., Schaumburg, Ill.

[21] Appl. No.: 258,227

[22] Filed: Apr. 27, 1981

[51] Int. Cl.[3] ..... G05F 1/56

[52] U.S. Cl. ..... 323/303; 323/273; 363/46

[58] Field of Search ..... 323/273, 280, 299, 303; 330/149, 257, 288, 296, 297, 302, 303; 363/45, 46

[56] References Cited

U.S. PATENT DOCUMENTS

| | | | |
|---|---|---|---|
| 3,222,538 | 12/1965 | Manners et al. | 323/280 X |
| 3,600,663 | 8/1971 | Wagner | 363/46 |
| 3,735,240 | 5/1973 | Davis et al. | 323/280 |
| 3,946,303 | 3/1976 | Streit et al. | 323/280 |

OTHER PUBLICATIONS

Maillet, "Slew Rate Improving Circuit for a Voltage Comparator", IBM Technical Disclosure Bulletin, vol. 19, No., 12, May 1977, pp. 4636, 4637.

Santamaria et al., "High Stability Variable Voltage Source", Electronic Engineering, vol. 50, No. 615, Nov. 1978, p. 34, S9039 0062.

*Primary Examiner*—A. D. Pellinen

*Attorney, Agent, or Firm*—Vincent B. Ingrassia

[57] ABSTRACT

In circuits such as voltage regulators and the like where parasitic currents may be generated as a result of high frequency ripple on the supply line, means are provided to cancel the effects of the parasitic current. A capacitor having a capacitance substantially equal to the parasitic capacitance is adapted to receive the supply voltage excursions and generate a current substantially equal to the parasitic current. A current mirror circuit or the like is employed to either divert this second current from the base of the output transistors or to reduce the drive current to the base of the output transistors by an amount equal to the second current.

11 Claims, 2 Drawing Figures

HIGH FREQUENCY LINE RIPPLE CANCELLATION CIRCUIT

BACKGROUND OF THE INVENTION

1. Field of the Invention

This invention relates generally to a circuit for minimizing the effects of high frequency line ripple and, more particularly to a monolithic voltage regulator (or other circuit which has a similar output configuration) including circuitry for cancelling the effects of high frequency line ripple.

2. Description of the Prior Art

It is desirable that circuits such as voltage regulators and the like be characterized by an output which has high frequency immunity from input supply variations. That is, the output voltage $V_{out}$ should be constant irrespective of high frequency variations in the supply voltage ($V_{CC}$). Unfortunately, high frequency AC variations (ripple) will appear at the output due to these high frequency supply variations and parasitic capacitances such as the collector-base capacitance of the output transistors.

SUMMARY OF THE INVENTION

It is an object of the present invention to provide a circuit for minimizing high frequency supply voltage ripple.

It is a further object of the present invention to provide an improved voltage regulator wherein the currents contributed by the parasitic capacitance are effectively cancelled so as to render the circuit output substantially immune from high frequency supply voltage ripple.

According a first aspect of the invention there is provided a circuit for cancelling parasitic current at a node due to voltage excursions across a first capacitance coupled to said node, comprising: capacitive means responsive to said voltage excursions for generating a first current substantially equal to said parasitic current; and means coupled to said capacitive means and to said node for substantially cancelling the net current at said node due to said voltage excursions.

According to another aspect of the invention there is provided a voltage regulator circuit, comprising: transistor output means adapted to receive a supply voltage and generating therefrom an output voltage, said transistor means having associated therewith a parasitic capacitance which causes a parasitic current to flow into said transistor means due to voltage excursions in said supply voltage; comparing means for comparing a voltage representative of said output voltage with a reference voltage and for controlling current flowing into said transistor means so as to adjust said output voltage; capacitive means having a capacitance substantially equal to said parasitic capacitance and adapted to receive said supply voltage excursions for generating a second current substantially equal to said parasitic current; and means for cancelling said parasitic current.

The above and other objects, features and advantages of the present invention will be more clearly understood from the following detailed description taken in conjunction with the accompanying drawings, in which:

DESCRIPTION OF THE PREFERRED EMBODIMENT

Figure 1:
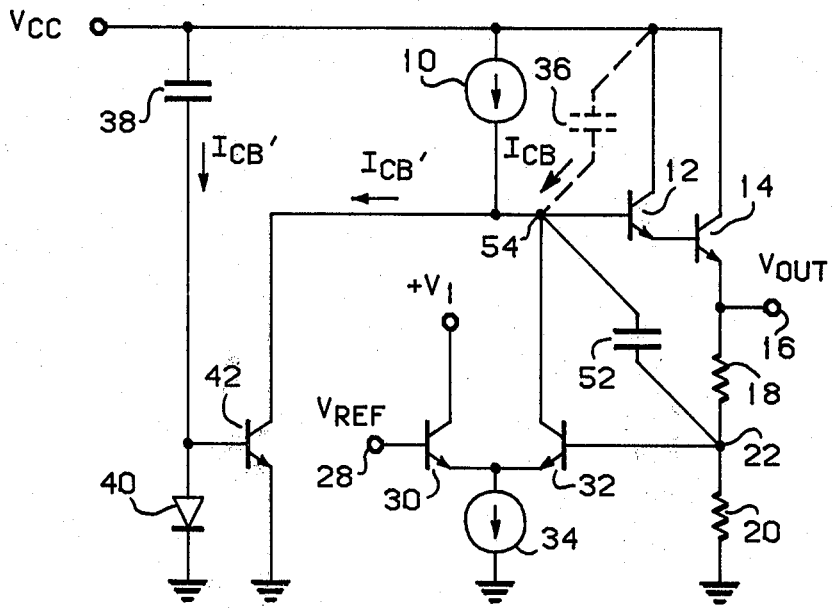
FIG. 1 is a schematic diagram of a first embodiment of the inventive high frequency supply ripple cancellation circuit used in conjunction with a voltage regulator.

FIG. 1 illustrates, in part, a typical voltage regulator circuit which comprises current source 10, output transistors 12 and 14, output terminal 16 which is coupled to the emitter of transistor 14, a voltage divider circuit including resistors 18 and 20 for generating a voltage at node 22 which is proportional to the output voltage, a stabilizing capacitor 52, a terminal 28 for receiving a reference voltage ($V_{ref}$) and a comparator including transistors 30 and 32 and current sink 34 for comparing the voltage at node 22 with the voltage at node 28.

The circuit operates as follows. Current source 10 coupled between the supply voltage $V_{CC}$ and the base of transistor 12 provides base drive to transistor 12 which has a collector coupled to $V_{CC}$ and an emitter coupled to the base of transistor 14. Thus, when transistor 12 turns on, it drives transistor 14 which also has a collector coupled to $V_{CC}$. Current flowing through the emitter of transistor 14 flows through resistors 18 and 20 to set up a voltage at node 22 which represents an indication of the output voltage $V_{out}$. This is applied to the base of transistor 32 which has an emitter coupled to current sink 34 and a collector coupled back to the base of transistor 12. As stated previously, a referance voltage appears at node 28 which is applied to the base of transistor 30. Transistor 30 has a collector coupled to $+V_1$ and an emitter coupled to current sink 34. In this manner, the voltage being generated at node 22 may be compared with the reference voltage at node 28.

It should be apparent, that as the voltage at node 22 increases above the reference voltage at node 28, transistor 32 will turn on harder causing base drive to be diverted from the base of transistor 12 through current sink 34. When this occurs, the drive to output follower transistor 14 is reduced thus reducing its emitter current and causing the output voltage to fall. If, on the other hand, the voltage at the output voltage were to fall to a point where the voltage at node 22 were lower than the reference voltage at node 28, transistor 32 would conduct less current thus permitting more base drive to be supplied to the base of transistor 12. This would in turn increase base drive to transistor 14 causing the output voltage ($V_{out}$) to rise. The capacitance (C) of capacitor 52 is multiplied by the gain (A) of differential transistor pair (30 and 32) and effectively appears at node 22 as A.C. This creates the dominant RC time constant of the feedback loop for frequency stability. Unfortunately, it prevents the regulator from reacting to rapid changes in current at node 46.

A problem arises with this circuit due to the well-known parasitic capacitance which exists between the collector and base terminals of a transistor such as is shown at 36. The current through a capacitor equals C(dv/dt) where C is the capacitance and dv/dt is the voltage change across the capacitor. If high frequency ripple appears on $V_{CC}$, dv/dt will be very high and the current $I_{CB}$ which is applied to the base of transistor 12 will also be high. This high frequency current component applied to the base of transistor 12 is not compensated for by the relatively slow negative feedback loop.

Thus, it is multiplied by the gain of transistor 12 and then applied to the base of transistor 14 and then multiplied by the gain of transistor 14. As a result of these multiplications, a substantial excursion in the output voltage ($V_{out}$) will occur at terminal 16.

To avoid the problem caused by rapid increases in supply voltage, a capacitor 38 and a current mirror circuit is provided of the type, for example, which includes a diode 40 and a transistor 42. Capacitor 38 is chosen to be substantially equal in value to that of parasitic capacitance 36 and is coupled between the source of supply voltage $V_{CC}$ and the current mirror circuit; i.e., the anode of diode 40 and the base of transistor 42. The collector of transistor 42 is coupled back to the base of transistor 12. Both the emitter of transistor 42 and the cathode of diode 40 are coupled to ground.

As stated previously, a high frequency positive going excursion in the supply voltage will cause a current $I_{CB}$ to flow into node 54. If capacitor 38 is properly chosen to be equal to the parasitic capacitance, a current equal to $I_{CB}$ ($I_{CB}'$) will flow through capacitor 38 into the current mirror circuit. This will cause current $I_{CB}'$ to also flow into the collector of transistor 42 due to the current mirroring action of diode 40 and transistor 42. Thus, even though an unwanted current $I_{CB}$ is flowing into node 54 as a result of parasitic capacitance 36, an equal current ($I_{CB}'$) is drawn away from node 54 thus substantially cancelling the parasitic effect and preventing any increase in the base current of transistor 12.

Figure 2:
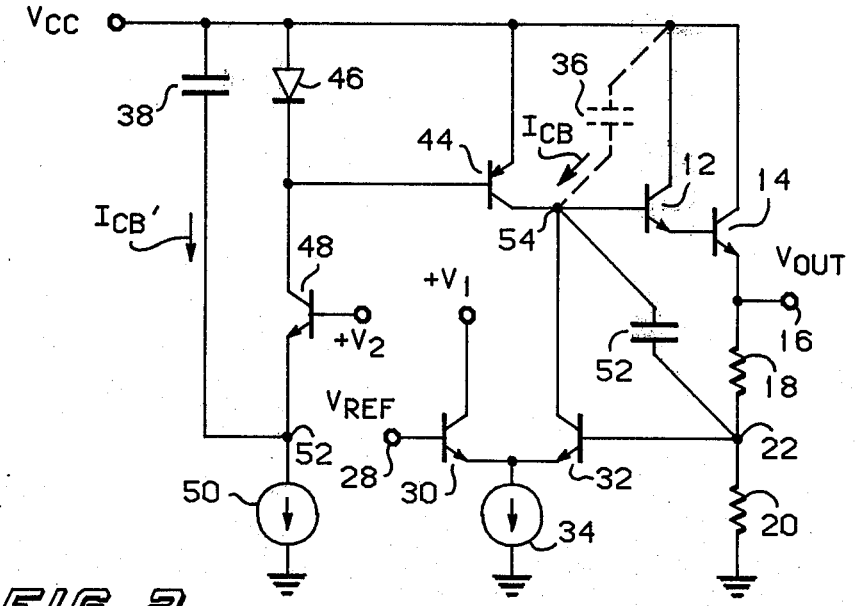
FIG. 2 is a schematic diagram of a second embodiment of the inventive high frequency supply ripple cancellation circuit used in conjunction with a voltage regulator.

FIG. 2 illustrates a second embodiment of the invention used in conjunction with a voltage regulator. Like elements in FIGS. 1 and 2 perform similar functions and will not be further described. In FIG. 2, the unwanted parasitic current $I_{CB}$ is assumed to flow into or out of the base of transistor 12 due to an increasing or decreasing supply voltage. This parasitic current is cancelled by means of the additional circuitry shown; i.e., diode 46, transistors 44 and 48, and current sink 50. As is shown in FIG. 2, capacitor 38 is now coupled between $V_{CC}$ and the emitter of transistor 48. The collector of transistor 48 is coupled to the base of transistor 44 and to the cathode of diode 46. The base of transistor 48 may be coupled to any voltage sufficient to keep transistor 48 in the active region. For simplicity, this is shown as $+V_2$. The emitter of transistor 44 is coupled to $V_{CC}$ and its collector is coupled to the base of transistor 12. The current which flows through diode 46 is mirrored to flow through transistor 44 into the base of transistor 12.

When $V_{CC}$ is increased rapidly, a current flows through capacitor 38 ($I_{CB}'$) which is substantially equal to $I_{CB}$ flowing through capacitor 36 as described previously. This additional current $I_{CB}'$ flows into node 52. This means, of course, that the current flowing through diode 46 into the collector of transistor 48 must be reduced by an amount $I_{CB}'$ and due to the current mirror action of diode 46 in conjunction with transistor 44, the current flowing in the collector of transistor 44 is also reduced by an amount $I_{CB}'$. While the current component $I_{CB}$ flowing through transistor 36 is not diverted away from the base of transistor 12, the current flowing through transistor 44 which normally drives transistor 12 is reduced by an amount substantially equal to the parasitic current. Therefore, the sum of the parasitic current and the collector current 44 is zero at node 54 and thus no net effect will occur at the output of the circuit. It should be noted that the above description applies for rapid decreases in supply voltage; i.e. a parasitic current $I_{CB}$ flows out of node 54 which is equal and opposite to the increase in collector current of transistor 44 flowing into node 54.

The above description is given by way of example only. Changes in forms and details may be made by one skilled in the art without departing from the scope of the invention.

I claim:

1. A circuit for minimizing the effects of parasitic current flowing into or out of the base of a first transistor as a result of supply voltage excursions across the base-collector parasitic capacitance of said first transistor, comprising:

capacitive means adapted to receive said supply voltage excursions for generating a first current substantially equal to said parasitic current; and means coupled to said capacitive means and to said transistor and responsive to said first current for cancelling the parasitic current at the base of said first transistor.

2. A circuit according to claim 1 wherein said capacitive means comprises a capacitor adapted to be coupled between a supply voltage and said means for cancelling.

3. A circuit according to claim 2 wherein said means for cancelling comprises a current mirror circuit coupled between said capacitive means and said first transistor.

4. A circuit according to claim 3 wherein said means for cancelling comprises a current mirror circuit which causes a current to flow into the base of said first transistor which is reduced by an amount equivalent to said first current.

5. A circuit for minimizing the effects of parasitic current flowing into or out of the base of a first transistor as a result of supply voltage excursions across the base-collector parasitic capacitance of said first transistor, comprising:

a capacitor adapted to receive said supply voltage excursions for generating a first current substantially equal to said parasitic current;

a current mirror circuit coupled between said capacitor and said first transistor and responsive to said first current for cancelling the parasitic current at the base of said first transistor, said current mirror circuit comprising;

a second transistor having a collector coupled to the base of said first transistor, an emitter coupled to ground and a base coupled to said capacitive means; and a diode having an anode coupled to said capacitive means and a cathode coupled to ground, said first current being mirrored into the collector path of said second transistor to divert said first current from the base of said first transistor.

6. A circuit for cancelling parasitic current at a node due to voltage excursions across a first capacitance coupled to said node, comprising:

capacitive means responsive to said voltage excursions for generating a first current substantially equal to said parasitic current; and means coupled to said capacitive means and to said node for substantially cancelling the net current at said node due to said voltage excursions.

7. A circuit according to claim 6 wherein said capacitive means is a capacitor coupled so as to receive said voltage excursions.

8. A circuit according to claim 7 wherein said means for cancelling comprises a current mirror circuit coupled between said capacitor and said node for receiving said first current and for pulling a second current from said node, said second current being substantially equal to said first current.

9. A circuit according to claim 7 wherein said means for cancelling comprises a current mirror circuit coupled between said capacitor and said node for generating a third current which flows into said node, said third current being reduced by an amount equivalent to said first current.

10. A circuit for cancelling parasitic current at a node due to voltage excursions across a first capacitance coupled to said node, comprising:

a capacitor coupled so as to receive said voltage excursions for generating a first current substantially equal to said parasitic current;

a current mirror circuit coupled between said capacitor and said node for receiving said first current and for pulling a second current from said node, said second current being substantially equal to said first current, said current mirror circuit comprising;

a first transistor having a collector coupled to said node, an emitter coupled to ground and a base coupled to said capacitor; and a diode having an anode coupled to the base of said first transistor and a cathode coupled to ground.

11. A voltage regulator circuit, comprising:

transistor output means adapted to receive a supply voltage and generating therefrom an output voltage, said transistor means having associated therewith a parasitic capacitance which causes a parasitic current to flow into said transistor means due to voltage excursions in said supply voltage;

comparing means for comparing a voltage representative of said output voltage with a reference voltage and for controlling current flowing into said transistor means so as to adjust said output voltage;

capacitive means having a capacitance substantially equal to said parasitic capacitance and adapted to receive said supply voltage excursions for generating a second current substantially equal to said parasitic current; and means coupled between said transistor output means and said capacitor means for cancelling said parasitic current.

* * * * *